United States Patent [19]

van den Broek

[11] 3,951,092

[45] Apr. 20, 1976

[54] ARRANGEMENT FOR TREATING A SHIP'S HULL

[75] Inventor: Bernardus Cornelis van den Broek, Weert, Netherlands

[73] Assignee: Maastrichtse Machinefabriek Delnoz B.V., Maastricht, Netherlands

[22] Filed: Dec. 9, 1974

[21] Appl. No.: 531,143

[30] Foreign Application Priority Data

Dec. 11, 1973 Netherlands ..... 7316929

[52] U.S. Cl. ..... 114/222; 51/9 M; 118/305

[51] Int. Cl.[2] ..... B63B 59/00

[58] Field of Search..... 114/222; 51/8, 9, 9 M; 212/10; 118/108, 207, 305

[56] References Cited

UNITED STATES PATENTS

| | | | |
|---|---|---|---|
| 3,396,492 | 8/1968 | Schenck | 51/8 |
| 3,566,543 | 3/1971 | Fogle | 51/9 M |
| 3,623,902 | 11/1971 | Hammelmann | 114/222 X |
| 3,827,187 | 8/1974 | Yamamoto et al. | 114/222 X |

*Primary Examiner*—Trigve M. Blix
*Assistant Examiner*—Stuart M. Goldstein
*Attorney, Agent, or Firm*—Burgess, Dinklage & Sprung

[57] ABSTRACT

The hull of a docked ship is treated with apparatus which includes a frame which can move horizontally along the dock wall. The frame has vertical guides and a carriage is movably mounted along the vertical guides. The carriage carries a device for treating the ship's hull which includes a two-part arm, the first or upper portion of which is connected to one end of the carriage for pivotal movement in a horizontal plane about a vertical pivot. The second or lower arm portion is connected at one end to the upper arm portion for pivotal movement in the horizontal as well as the vertical plane about two right-angled pivots. At the other end, the lower arm has a bracket and platform arrangement on which the actual treating device is mounted for pivotal movement.

9 Claims, 10 Drawing Figures

ARRANGEMENT FOR TREATING A SHIP'S HULL

The invention relates to an arrangement for cleaning and conserving the hull of a docked ship.

A known arrangement, which is specially intended for grit blasting a ship's hull, is provided with a vehicle movable over the dock wall or quay-wall of a dry dock, a vertical beam mounted thereon which is movable perpendicularly to the dock wall, and a carriage movable vertically along said beam. The carriage is provided with grit blasting apparatus which is kept at a predetermined distance from the ship's hull by means of said arrangement. The drawback of the above arrangement is that strongly arched contours of ship's hulls, in particular at the stem and stern of ships and the hulls of submarines can only be treated with difficulty, because the apparatus cannot be kept opposite the surface of said arched portions.

It is an object of the present invention to eliminate the above drawback and to provide an arrangement by means of which large surfaces of varying contours can be treated automatically in a short period of time.

For this purpose according to the invention the carriage which is movable along the dock wall is provided with a swivelling two-part arm consisting of a first or upper arm which is connected at one end to the carriage for movement in a horizontal plane about a vertical pivot, and of a second or lower arm which is connected at one end to the upper arm for movement in the horizontal as well as in the vertical plane about two right-angled pivots, and at the other end provided with a bracket having a platform on which the treating apparatus is mounted.

The bracket is so connected to the pivot of the lower arm that during the pivotal movement of the lower arm in the vertical plane said bracket remains in the horizontal position.

Furthermore, the bracket is mounted on the end of the lower arm for pivotal movement about a horizontal axis, and the platform is mounted on the bracket for rotation about a vertical axis.

According to one embodiment of this invention the treating apparatus is mounted on a frame which is disposed on the platform for pivotal movement about a horizontal axis. Such a treating arrangement can thus be moved in a simple manner along the ship's hull, so that the apparatus can treat all parts of the ship's hull, irrespective of the shape of the vessel. In order to maintain the proper distance between the apparatus and the hull to be treated, irrespective of the shape thereof, the arrangement is provided with feelers means which automatically control the working distance between the treating means and the ship's hull.

These feeler means comprise two spacers mounted on the ends of the frame, and one mounted on the platform.

The treating apparatus may be provided with sand or grit blasting nozzles.

Furthermore the treating apparatus may also be provided with rotary cleaning equipment.

When the apparatus is used for painting a ship, it may be provided with paint spray nozzles which are so arranged as to have slightly overlapping areas.

The moving system of the entire arrangement according to this invention is operated hydrostatically, the distance between the treating apparatus and the ship's hull being automatically adjusted by the electronic spacing means with return signal arrangement.

One embodiment of the invention will now be described with reference to the accompanying drawings wherein.

Figure 9:
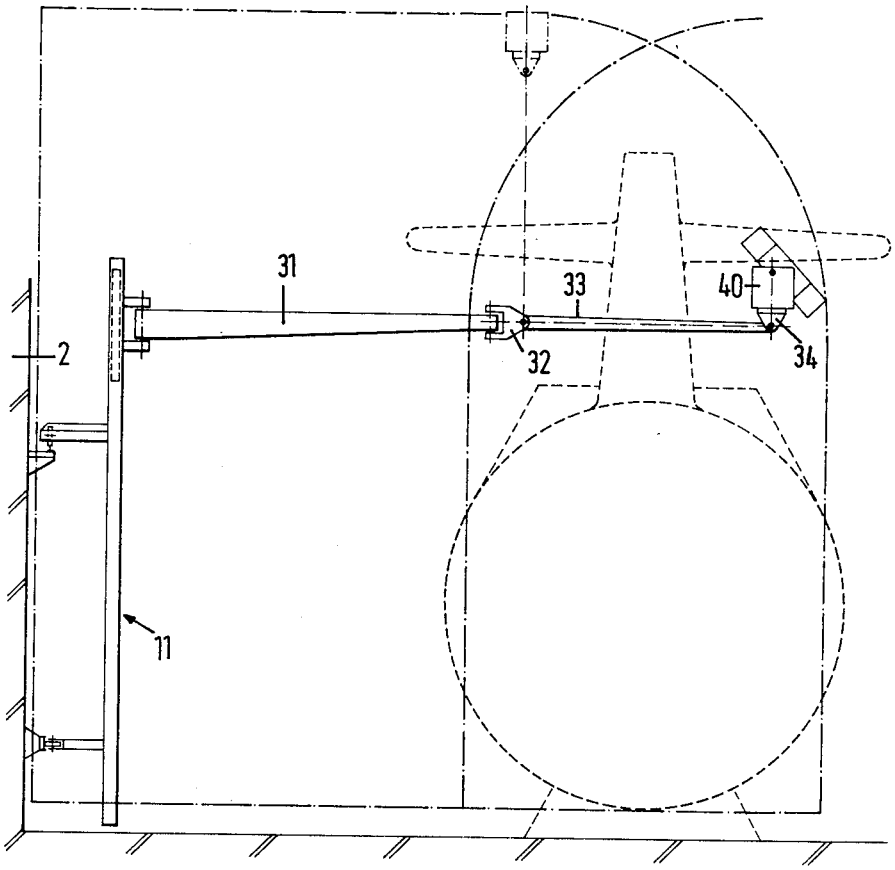

FIG. 9 schematically shows a cross-section of a dry dock accommodating a submarine.

Figure 10:
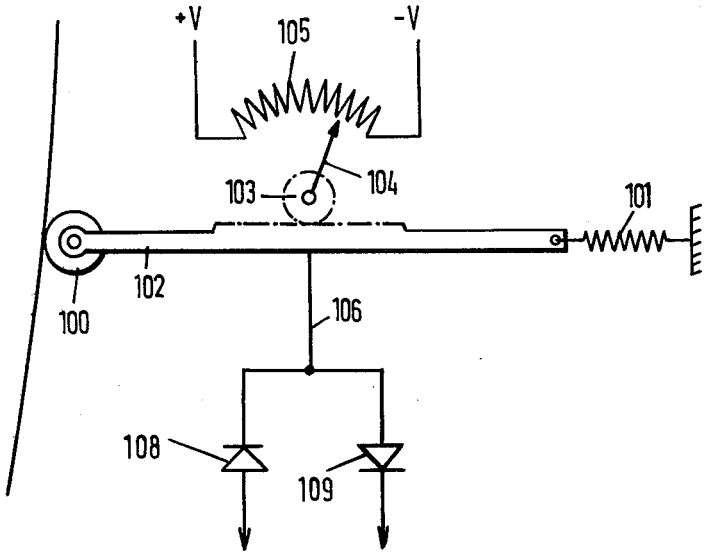

FIG. 10 shows a rolling feeler with an associated electric circuit as used in the arrangement according to the invention.

Figure 1:
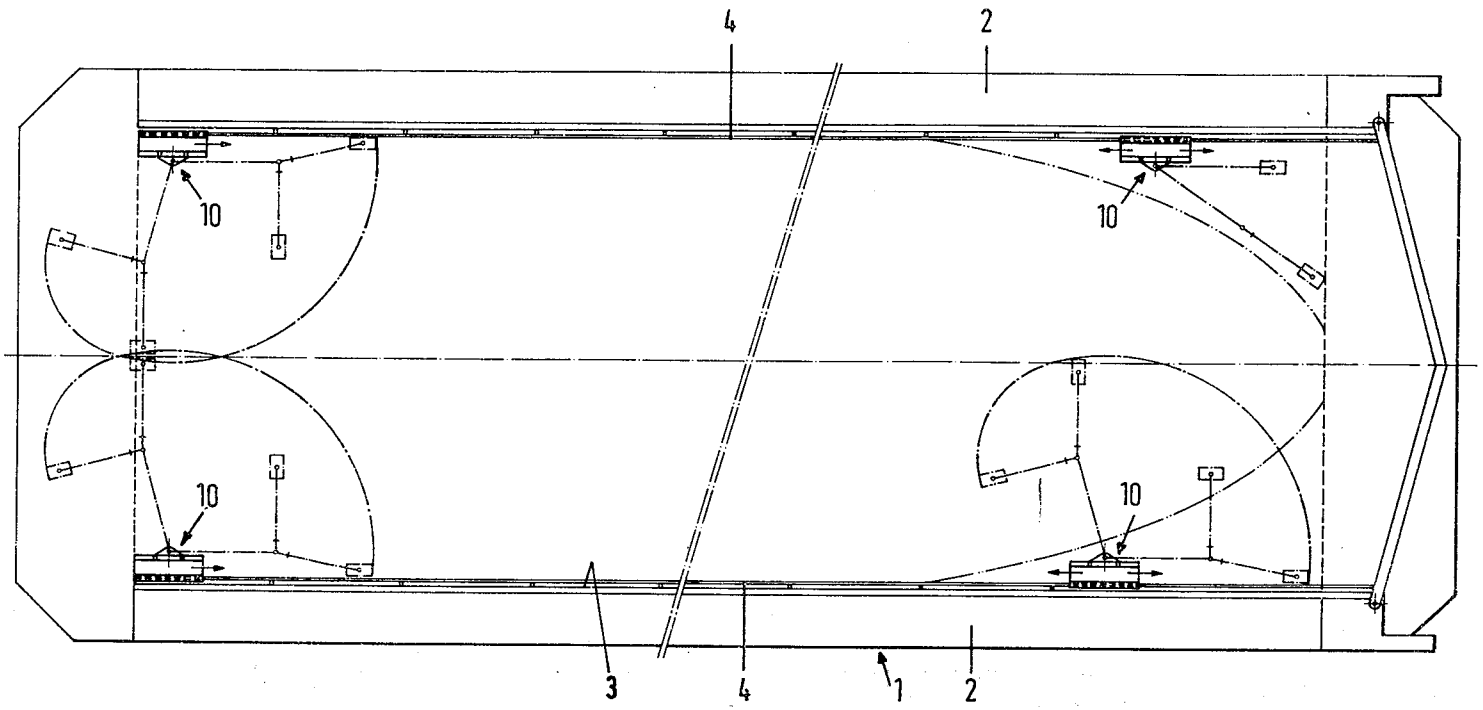
FIG. 1 is a top view of a dry dock provided with four treating arrangements installed on its walls.

FIG. 1 shows a floating dock 1 provided with two pairs of horizontal guides 4 and 5 disposed along the inner walls 3 of the ballast tanks 2.

On each pair of guides 4 and 5 there are installed two treating arrangements 10 for horizontal movement along the dock wall.

Figure 2:
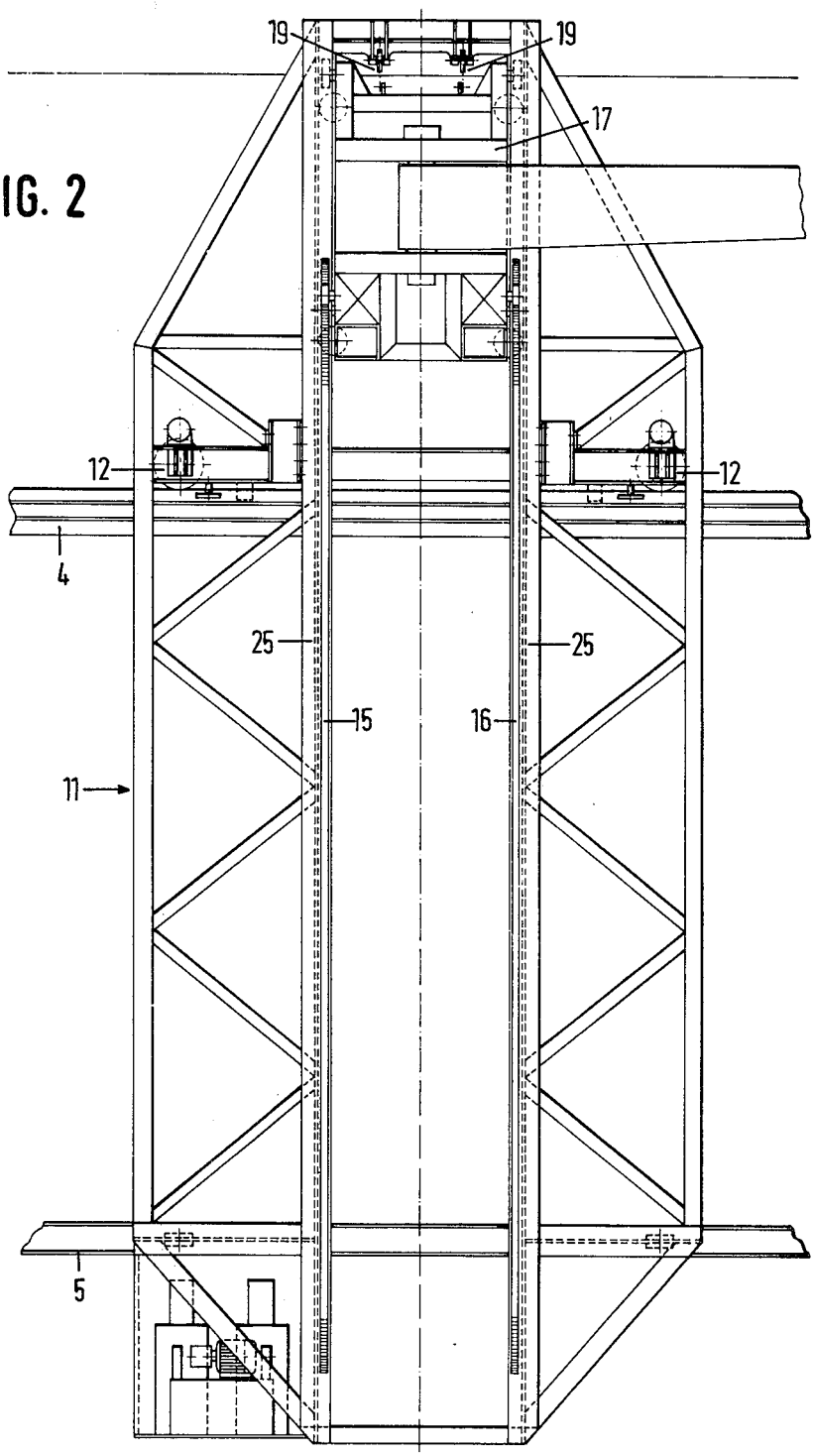
FIG. 2 is a front view of the carriage pertaining to said treating arrangement.
Figure 3:
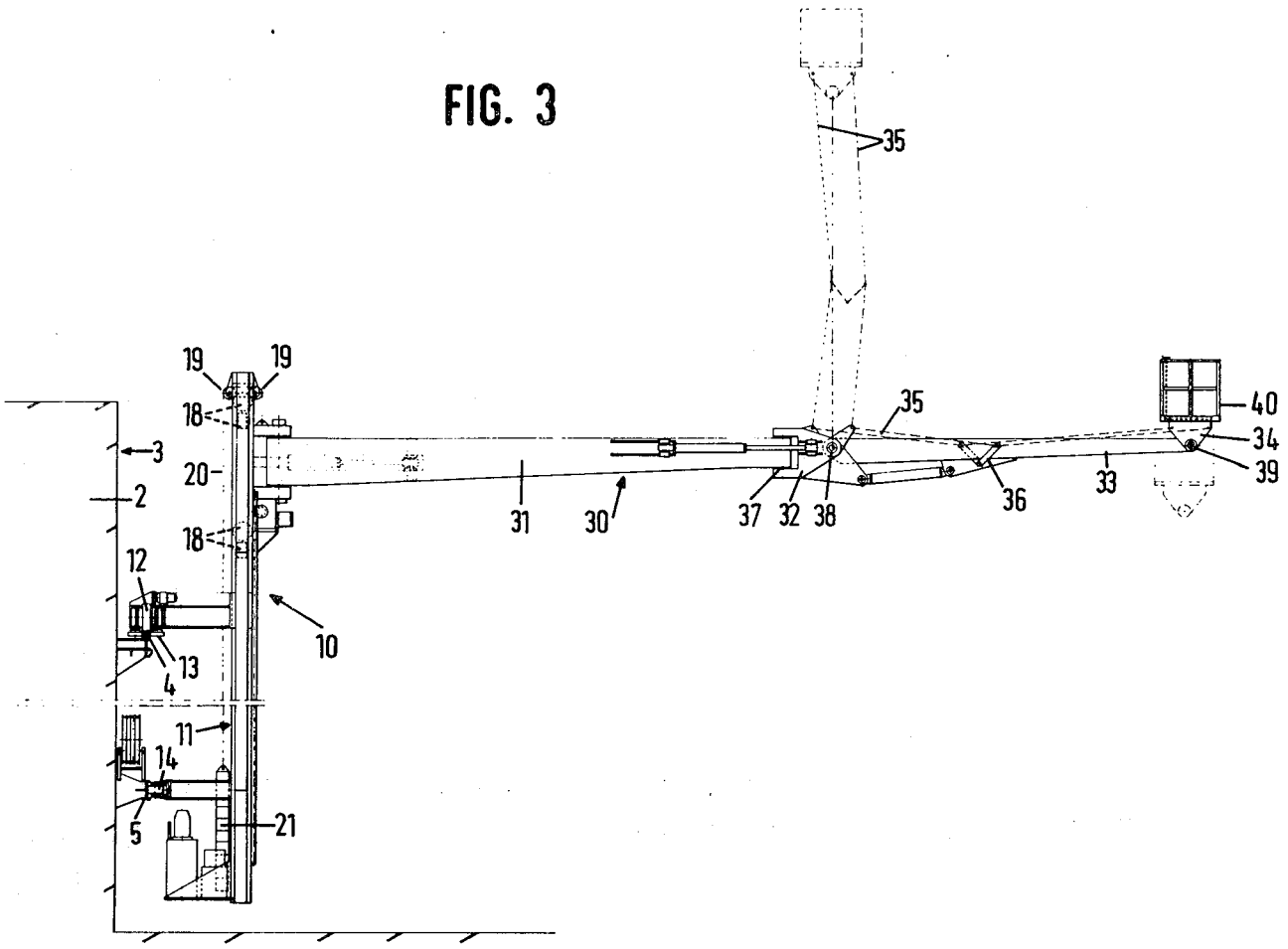
FIGS. 3 and 4 are a side view, respectively top view of the entire treating arrangement.
Figure 4:
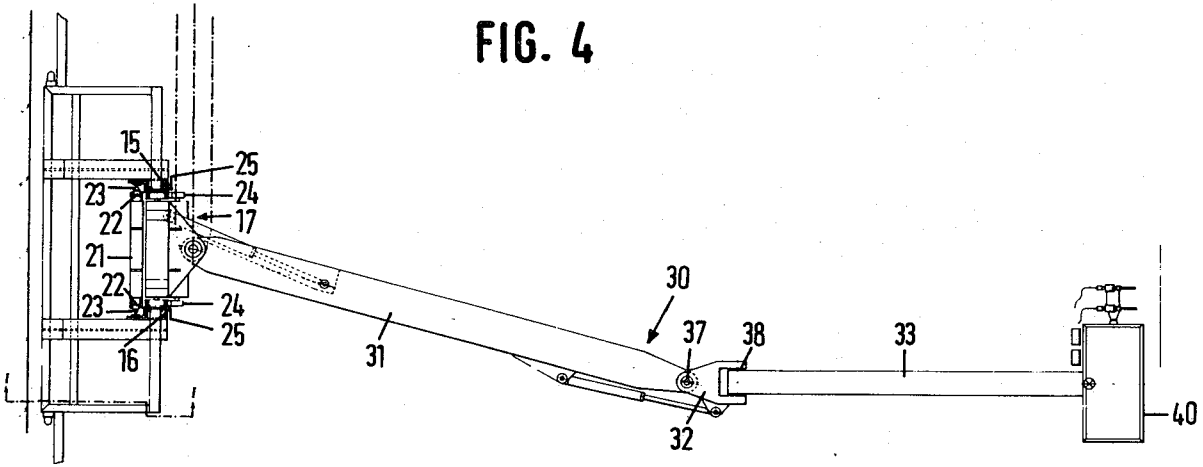

As shown in FIGS. 2 and 3 each treating arrangement 10 comprises a vertical frame 11 which is constructed as an open frame. Said frame 11 is moved horizontally along the dock wall by means of driven wheels 12 movable along the guide 4, said frame 11 moveover being guided by means of guide rollers 13 and 14 movable along the guide rails 4 and 5, respectively.

The vertical frame 11 is provided with two parallel, vertical guides 15 and 16 having racks 25. A carriage 17 is installed for vertical movement between the two guides 15 and 16 by means of guide rollers 18. The carriage 17 is connected to a counterweight 21 by means of connecting members 20, such as chains or cables and the like, conducted over pulleys 19 at the top end of the frame 11. The counterweight 21 is guided by means of guide rollers 22 along two rails 23 disposed on the frame 11 parallel to the guides 15 and 16. The carriage 17 is vertically movable along the guides 15 and 16 by means of driven toothed wheels 24 engaging with the racks 25 on the guides 15 and 16.

On the carriage 17 there is mounted for pivotal movement in a horizontal plane one end of a horizontal first or upper arm 31 of a two-part arm 30. A bridging member 32 connecting the upper arm 31 to a second or lower arm 33 of the two-part arm is connected to the upper arm 31 for movement about a pivot 37. The lower arm 33 is connected to the bridging member 32 via a horizontal pivot 38. At the free end of the lower arm 33 there is connected to said lower arm a bracket 34 by means of a horizontal pivot 39 which is parallel to the pivot 38. For the bracket 34 to remain in the horizontal position during the pivotal movement of the lower arm 33 in a vertical plane, the bracket is so connected to the bridging member 32 by means of rods 35 that during the pivotal movement of the lower arm 33 in a vertical plane the upper surface of the bracket remains in the horizontal position. In order to restrict the collapsing length of the rods 35 they are constructed as two pairs of rods and for each pair of rods a lever 36 is mounted approximately in the middle of said lower arm.

On the bracket 34 there is mounted for rotation about a vertical axis a platform 40 for the operator. At one side of the platform there is provided a rectangular frame 41 rotatable about a horizontal axis. To this frame are attached one or more apparatuses for treating the ship's hull. Such an apparatus may be a so-called cleaning beam 42 consisting of a hollow tube 43 having a plurality of nozzles 44 through which sand or grit is blown with great force against the ship's hull for removal of dirt, rust, fouling, rests of paint and the like. The cleaning beam may also be provided with rotary wire brushes (not shown). Furthermore the treating apparatus may consist of a so-called painting beam provided with a paint conduit 45 with spray nozzles 46. The nozzles 44 for the grit and the paint spray nozzles 46 are so arranged that the spray cones of the sprayed matter slightly overlap each other.

Since on the one hand the platform 40 is rotatable in the horizontal plane and on the other hand the frame 41 is rotatable in a vertical plane relative to said platform, the cleaning beam or painting beam can always be kept parallel to the ship's hull, even where the latter is not truly vertical as at the stem and stern of the ship.

Even a submarine with its strongly rounded shape can be treated with the above arrangement.

In the above-described embodiment the various parts of the arrangement are moved by lineary and/or rotary hydraulic motors. For adjusting the proper distance between the treating apparatus and the hull said motors are controlled by an electronic spacing system for the control signals of which three feelers follow the hull.

Figure 5:
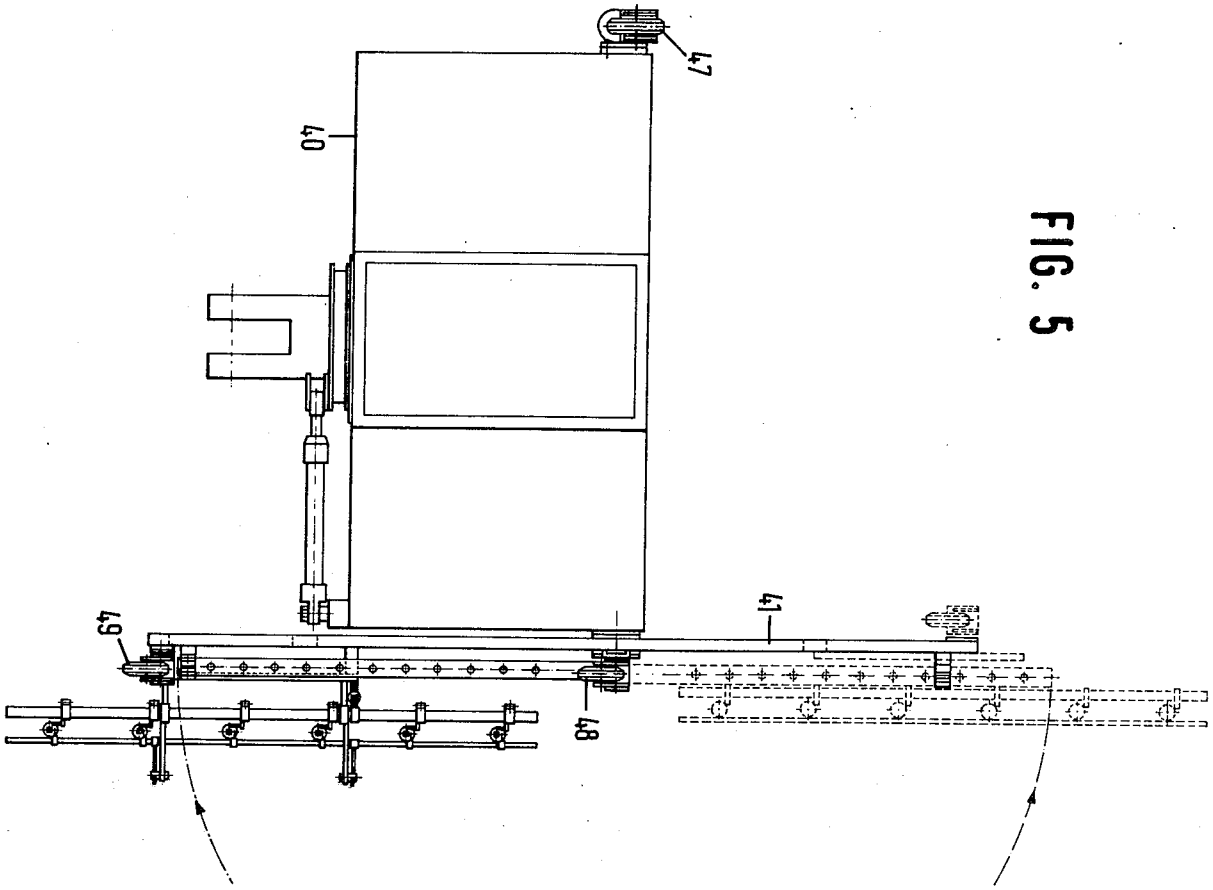
FIG. 5 is a front view of the platform with a frame whereon said treating apparatus is mounted.

FIG. 5 shows three roller feelers, viz. a feeler 47 at the left-hand side of the platform 40 and two feelers 48 and 49 on the frame 41.

Figure 6:
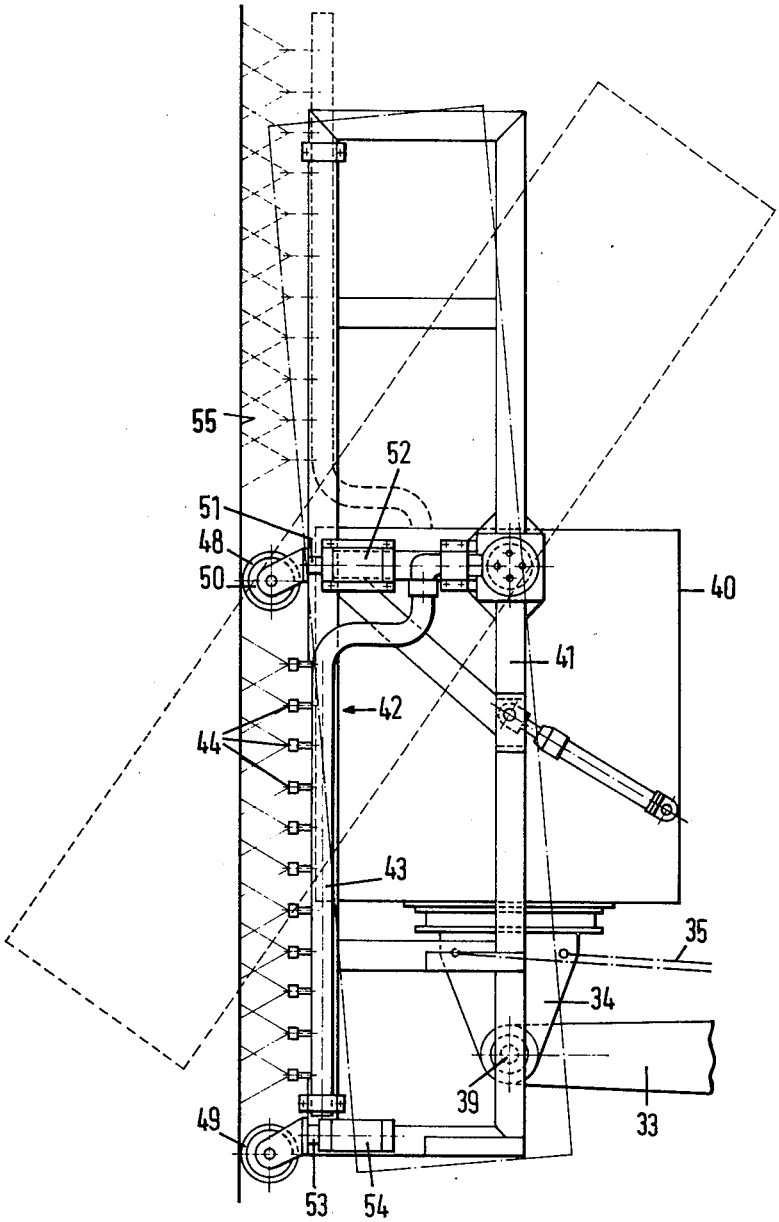
FIG. 6 is a side view of the platform shown in FIG. 5 provided with cleaning nozzles.
Figure 7:
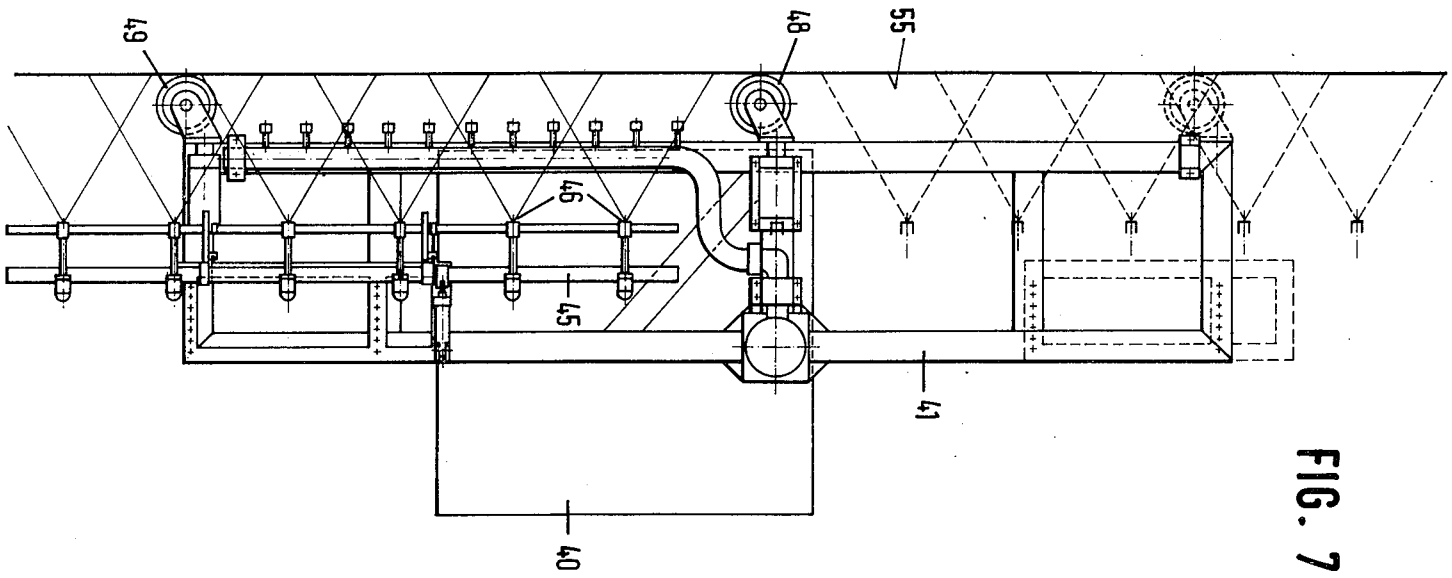
FIG. 7 shows the treating apparatus provided with paint spray nozzles.

As shown in FIGS. 6 and 7, a scanner or feeler 48 is formed by a roller rotatably connected between two ears 50 at the protruding end of the valve rod 51 of the sliding valve 52. In the same way, scanner 49 is mounted on the valve rod 53 of the sliding valve 54. As shown in FIG. 6, the scanners 47, 48 and 49 are spring-urged against the hull 55. Where the hull recedes one or more feelers leave their neutral position and impart an electronic control signal to the hydrostatic drive, so that one or more motors are started for moving the arm together with the platform into the direction of the hull. When the correct position is attained, a return signal causes the drive to be stopped.

At bulging portions of the hull, e.g., under the bow of the ship, the above process will take place in the reverse order during the horizontal or vertical movement of the platform with a similar result.

Figure 8:
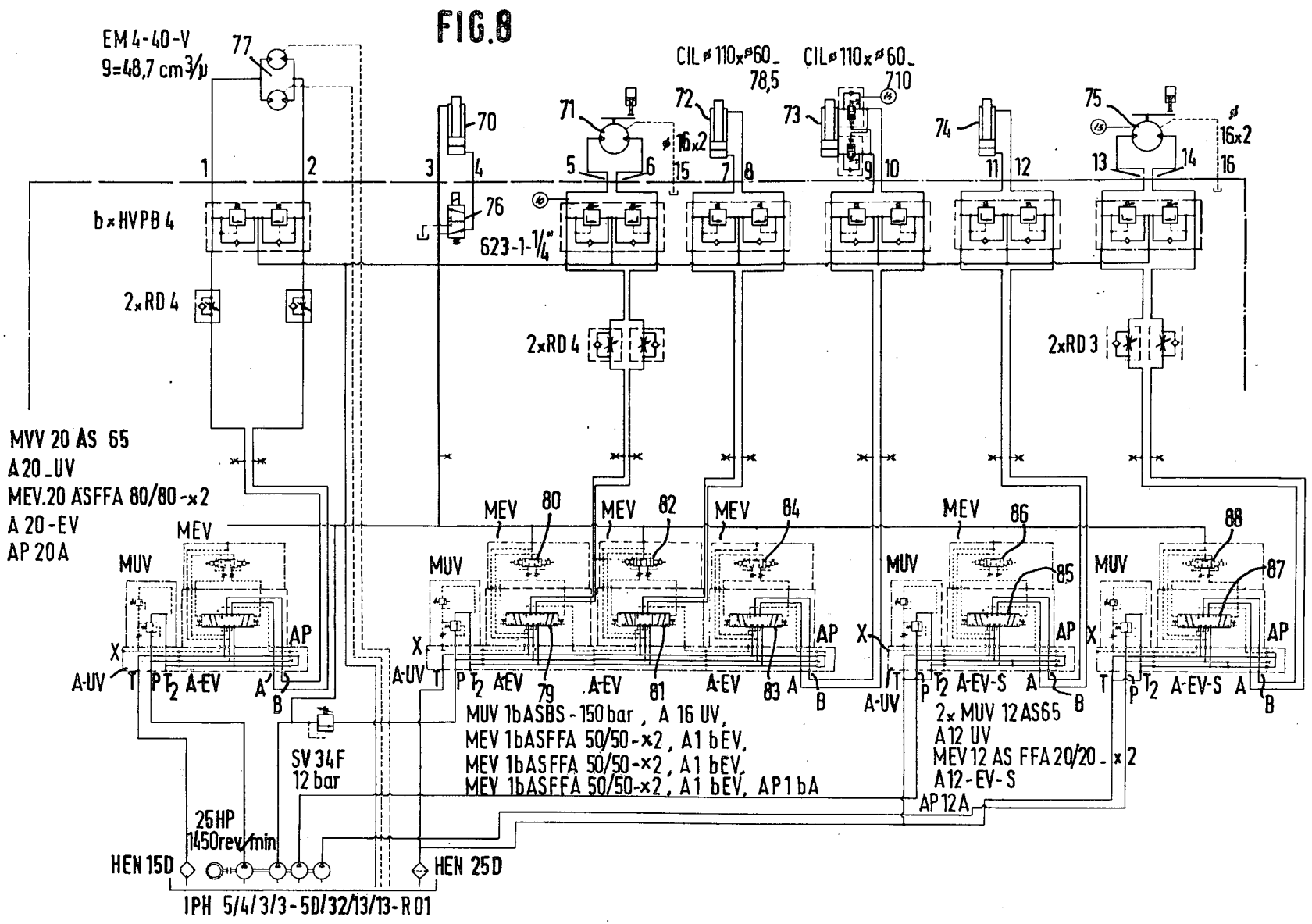
FIG. 8 is a block diagram of the electro-hydraulic control.

FIG. 8 is a diagram for a hydraulic control of the arrangement. The hydraulic cylinder unit 70 serves for displacing the rectangular frame 41 about a horizontal axis perpendicular to the ship's hull. This cylinder 70 can be operated by means of the two-position slide 76. The hydraulic cylinder unit 72 serves for pivoting the upper arm 31 in a horizontal plane and the cylinder unit 74 serves for pivoting the rectangular frame 41 about a horizontal axis parallel to the ship's hull. The cylinder units 72 and 74 are energized through the three-position slides 81 and 85, respectively, the positions of which are controlled by, for example, electrically operated control slides 82 and 86, respectively. These control slides 82 and 86 can be operated, just as the electrically operated control slides 80 and 88, by means of the electronic feelers 47, 48 and 49, which produce an electric signal depending on the distance between the frame 41 and the ship's hull. For example, feeler 48 applies signals to control slides 80 and 82. Control slide 80 and the three-position slide 79 energize a hydraulic motor 71 which causes the cylinder unit to pivot the lower arm 31. Thus, the signals of feeler 48 control the distance from the platform 40 to the ship's hull, but not the position of the frame 41 with respect to the ship's hull. In the case described this position is controlled by the feelers 47 and 49 (see FIG. 5). Feeler 47 controls the pivotal movement of the platform 40 or the frame 41 about a vertical axis by applying signals to control slide 88 which controls the three-position slide 87. The hydraulic motor 74 controls through a cylinder unit the rotation of the platform about a vertical axis. The displacement of the frame 41 about a horizontal axis parallel to the ship's hull is controlled by feeler 49, which can energize control slide 86, so that the three-position slide 85 takes the right position to have the frame 41 perform a rotary movement or not.

The hydraulic motors 77 serve for displacing the carriage 17 in vertical direction along guides 15 and 16 and are driven through the three-position valve 89, operated through control slide 90. Similarly, the control slide 84 and the three-position slide 83 control the hydraulic cylinder unit 73 for pivoting the lower arm 31 in a vertical plane. The hydraulic fluid is pressurized by a number of pumps driven by electric motor 78. For the rest the diagram shown in FIG. 8 contains further hydraulic components, which will be clear to an expert.

FIG. 10 shows a rolling feeler with an associated schematic diagram. The feeler (47, 48 or 49) comprises a rolling part 100 adapted to roll along the ship's hull. The rolling part 100 is spring-urged against the ship's hull by spring means 101. When the distance from the frame or the platform to which the feelers are attached, to the ship's hull is changed, a rack 102, at the end of which the rolling part is positioned, is displaced with respect to a pinion 103, which is fixedly mounted on the frame or the platform. This causes the pinion 103 to rotate. An electrically conductive arm 104 is fixedly mounted on the pinion. The arm 104 can run with one end along a resistive path 105 and is connected with the other end to an output conductor 106. The resistive path is preferably connected with one end to a positive voltage $+\nu$ and with the other end to a negative voltage $-\nu$. When the arm 104 is with one end in the middle of the resistive path, the voltage on the output conductor is 0 volts. However, if the rolling part moves to the left because the ship's hull recedes, for example, the arm will move to the right and a negative voltage is produced at the output conductor, said voltage being passed by a diode 108 and which may serve to control an electromagnetically controlled hydraulic valve, which again can control a hydraulic motor, which causes the frame or platform to move to the left. Thus, the arm 104 again takes the central position, the output voltage becomes 0 volts and the movement of frame or platform is stopped.

Similarly, a diode 109 can control a hydraulic valve, said valve causing the frame or platform to move to the right.

The arrangement may of course also be operated by electric or pneumatic motors, but hydrostatic operation is preferred, because in a dry dock it is reliable and safe and because it has a maximum initial torque. Moreover it is less sensitive to moisture and dirt owing to its closed system.

The advantages of the novel arrangement over existing methods of cleaning on painting a ship are significant. When the length of the cleaning or painting beam is 1 meter, a strip of 1.20 meters in width is treated in a single horizontal operation at a rate which is at least ten times that of a hand-operated nozzles. Moreover, the thickness of the coat of paint to be applied can be accurately determined to within millimeters by controlling the outflow rate of the paint and the rate of movement of the platform with the painting beam. It is evident that with this novel arrangement a ship's hull can be painted with relatively less paint and in a shorter period of time than when using conventional methods.

Owing to the high degree of mobility of the above-described arrangement, about 95% of the total surface of the ship's hull can be treated automatically.

I claim:

1. Apparatus for cleaning and conserving the hull of a docked ship adjacent a dock wall comprising frame means movable horizontally along the dock wall, said frame means having vertical guide means and carriage means movable along said guide means, said carriage means carrying means for treating a ship's hull, said carriage means being provided with a two-part arm consisting of a first or upper arm portion which is connected at one end to the carriage means for pivotal movement in a horizontal plane about a vertical pivot and a second or lower arm portion which is connected at one end thereof to the upper arm portion for pivotal movement in the horizontal as well as in the vertical plane about two rightangled pivots and at the other end, said lower arm portion having bracket and platform means on which the treating means is mounted for pivotal movement.

2. Apparatus of claim 1 wherein bracket means is connected to the pivot of the lower arm portion such that during the movement of the lower arm portion in the vertical plane said bracket means remains in the horizontal position.

3. Apparatus of claim 2 wherein the bracket means is mounted on the lower end of the lower arm portion for pivotal movement about a horizontal axis, the platform means is mounted on the bracket means for rotation about a vertical axis, and that the treating means is mounted on frame means which is positioned on the platform means for pivotal movement about a horizontal axis.

4. Apparatus of claim 2 wherein electronic spacing means with return signal arrangement are provided which automatically control the working distance between the treating means and the ship's hull.

5. Apparatus of claim 4 wherein the spacing means comprise two feelers mounted on the ends of a frame and one feeler mounted on the platform means.

6. Apparatus of claim 2 wherein the treating means is provided with sand or grit blasting nozzles.

7. Apparatus of claim 2 wherein the treating means is provided with rotary cleaning equipment.

8. Apparatus of claim 2 wherein the treating means is provided with paint spray nozzles which are so arranged as to have slightly overlapping areas.

9. Apparatus of claim 4 wherein the moving system of the entire arrangement is operated hydrostatically, the distance between the treating means and the ship's hull being automatically adjusted by the electronic spacing means with return signal arrangement.

* * * * *